US006585339B2

(12) United States Patent
Schloeman et al.

(10) Patent No.: US 6,585,339 B2
(45) Date of Patent: Jul. 1, 2003

(54) MODULE MANAGER FOR WIDE-ARRAY INKJET PRINTHEAD ASSEMBLY

(76) Inventors: Dennis J. Schloeman, 6065 NW. Vineyard Dr., Corvallis, OR (US) 97330; Daryl E. Anderson, 32991 SE. White Oak Rd., Corvallis, OR (US) 97333; Michael J. Barbour, 2995 NW. Garryanna Dr., Corvallis, OR (US) 97330

( * ) Notice: Subject to any disclaimer, the term of this patent is extended or adjusted under 35 U.S.C. 154(b) by 0 days.

(21) Appl. No.: 09/755,226

(22) Filed: Jan. 5, 2001

(65) Prior Publication Data

US 2002/0089557 A1 Jul. 11, 2002

(51) Int. Cl.[7] ..... B41J 29/38

(52) U.S. Cl. ..... 347/12; 347/13; 347/180; 347/211; 347/42

(58) Field of Search ..... 347/12, 13, 40, 347/10, 42, 5, 180, 181, 182, 9, 130, 211

(56) References Cited

U.S. PATENT DOCUMENTS

| | | | | |
|---|---|---|---|---|
| 4,463,359 A | | 7/1984 | Ayata et al. | 346/1.1 |
| 4,525,727 A | * | 6/1985 | Kohashi et al. | 346/140 |
| 4,595,935 A | | 6/1986 | Brooks et al. | 346/76 PH |
| 4,596,995 A | * | 6/1986 | Yamakawa et al. | 346/160 |
| 4,695,853 A | | 9/1987 | Hackleman et al. | 346/140 R |
| 4,695,854 A | | 9/1987 | Cruz-Uribe | 346/140 R |
| 4,719,477 A | | 1/1988 | Hess | 346/140 R |
| 4,764,659 A | | 8/1988 | Minami et al. | 219/216 |
| 4,982,199 A | | 1/1991 | Dunn | 346/1.1 |
| 4,989,224 A | * | 1/1991 | Narahara et al. | 377/39 |
| 4,999,650 A | | 3/1991 | Braun | 346/140 R |
| 5,016,023 A | | 5/1991 | Chan et al. | 346/1.1 |
| 5,030,971 A | | 7/1991 | Drake et al. | 346/140 R |
| 5,049,898 A | | 9/1991 | Arthur et al. | 346/1.1 |
| 5,057,854 A | | 10/1991 | Pond et al. | 346/140 R |
| 5,079,189 A | | 1/1992 | Drake et al. | 437/209 |
| 5,098,503 A | | 3/1992 | Drake | 156/299 |

(List continued on next page.)

FOREIGN PATENT DOCUMENTS

| | | | |
|---|---|---|---|
| EP | 0547921 A2 | 6/1993 | B41J/2/175 |
| JP | 07242004 | 3/1994 | B41J/2/30 |
| JP | 08127140 | 10/1994 | B41J/2/30 |

OTHER PUBLICATIONS

Allen, Ross R., "Ink Jet Printing with Large Pagewide Arrays: Issues and Challenges," Recent Progress in Ink Jet Technologies II, Chapter 2, pp. 114–120.

*Primary Examiner*—John Barlow
*Assistant Examiner*—Lam S Nguyen

(57) ABSTRACT

A wide-array inkjet printhead assembly includes a carrier and N printheads and a module manager disposed on the carrier. The module manager receives a serial input data stream and corresponding input clock signal from a printer controller located external from the inkjet printhead assembly. The module manager demultiplexes the serial data stream into N serial output data streams. The module manager provides the N serial output data streams and N corresponding output clock signals based on the input clock signal to the N printheads.

23 Claims, 5 Drawing Sheets

U.S. PATENT DOCUMENTS

| | | | | | |
|---|---|---|---|---|---|
| 5,103,246 | A | | 4/1992 | Dunn | 346/140 R |
| 5,160,945 | A | | 11/1992 | Drake | 346/140 R |
| 5,327,165 | A | | 7/1994 | Elliott | 346/76 PH |
| 5,363,134 | A | | 11/1994 | Barbehenn et al. | 347/49 |
| 5,365,312 | A | | 11/1994 | Hillmann et al. | 355/206 |
| 5,371,530 | A | | 12/1994 | Hawkins et al. | 347/9 |
| 5,541,629 | A | | 7/1996 | Saunders et al. | 347/12 |
| 5,604,513 | A | | 2/1997 | Takahashi et al. | 345/153 |
| 5,610,635 | A | | 3/1997 | Murray et al. | 347/7 |
| 5,646,660 | A | * | 7/1997 | Murray | 347/59 |
| 5,648,804 | A | | 7/1997 | Keefe et al. | 347/47 |
| 5,696,544 | A | | 12/1997 | Komuro | 347/50 |
| 5,719,605 | A | | 2/1998 | Anderson et al. | 347/59 |
| 5,742,305 | A | | 4/1998 | Hackleman | 347/42 |
| 5,755,024 | A | | 5/1998 | Drake et al. | 29/611 |
| 5,815,172 | A | | 9/1998 | Moh | 347/14 |
| 5,815,180 | A | | 9/1998 | Barbour et al. | 347/59 |
| 5,867,183 | A | * | 2/1999 | Cornell et al. | 347/13 |
| 5,886,718 | A | | 3/1999 | Johnson et al. | 347/85 |
| 5,946,012 | A | | 8/1999 | Courian et al. | 347/63 |
| 6,002,420 | A | * | 12/1999 | Tanioka et al. | 347/237 |
| 6,091,891 | A | | 7/2000 | Overall et al. | 395/112 |
| 6,109,716 | A | | 8/2000 | Takahashi | 347/11 |
| 6,126,261 | A | | 10/2000 | Yamanaka | 347/12 |
| 6,178,009 | B1 | | 1/2001 | Yamada et al. | 358/1.9 |
| 6,193,345 | B1 | | 2/2001 | Feinn et al. | 347/12 |
| 6,322,183 | B1 | * | 11/2001 | Kubota et al. | 347/10 |
| 6,493,106 | B1 | * | 12/2002 | Gauthier et al. | 358/1.1 |

* cited by examiner

MODULE MANAGER FOR WIDE-ARRAY INKJET PRINTHEAD ASSEMBLY

THE FIELD OF THE INVENTION

The present invention relates generally to inkjet printheads, and more particularly to a wide-array inkjet printhead assembly.

BACKGROUND OF THE INVENTION

A conventional inkjet printing system includes a printhead, an ink supply which supplies liquid ink to the printhead, and an electronic controller which controls the printhead. The printhead ejects ink drops through a plurality of orifices or nozzles and toward a print medium, such as a sheet of paper, so as to print onto the print medium. Typically, the orifices are arranged in one or more arrays such that properly sequenced ejection of ink from the orifices causes characters or other images to be printed upon the print medium as the printhead and the print medium are moved relative to each other.

In one arrangement, commonly referred to as a wide-array inkjet printing system, a plurality of individual printheads, also referred to as printhead dies, are mounted on a single carrier. As such, a number of nozzles and, therefore, an overall number of ink drops which can be ejected per second is increased. Since the overall number of drops which can be ejected per second is increased, printing speed can be increased with the wide-array inkjet printing system.

Typically, the printhead ejects the ink drops through the nozzles by rapidly heating a small volume of ink located in vaporization chambers with small electric heaters, such as thin film resisters. Heating the ink causes the ink to vaporize and be ejected from the nozzles. Typically, for one dot of ink, a remote printhead controller typically located as part of the processing electronics of a printer, activates an electrical current from a power supply external to the printhead. The electrical current is passed through a selected thin film resister to heat the ink in a corresponding selected vaporization chamber.

One problem with wide-array inkjet printing systems, is that the number of nozzles on a single carrier is quite large, and the number of corresponding thin film resisters which need to be electrically coupled to the remote printhead controller results in a correspondingly large number of conductive paths carrying nozzle firing and other data signals to the printheads. The interconnect count and printer overhead for managing such large numbers of nozzle firing and other data signals significantly increases the cost of producing a wide-array inkjet printing system.

For reasons stated above and for other reasons presented in greater detail in the Description of the Preferred Embodiment section of the present specification, a wide-array inkjet printing system is desired which minimizes the number of conductive paths carrying data signals to and from the printheads.

SUMMARY OF THE INVENTION

One aspect of the present invention provides an inkjet printhead assembly including a carrier, N printheads disposed on the carrier, and a module manager disposed on the carrier. The module manager receives a serial input data stream and a corresponding input clock signal from a printer controller located external from the inkjet printhead assembly. The module manager demultiplexes the serial data stream into N serial output data streams. The module manager provides the N serial output data streams and N corresponding output clock signals based on the input clock signal to the N printheads.

In one embodiment, the input data stream comprises print data, such as nozzle data. In one embodiment, the N printheads each include a plurality of nozzles. The nozzle data controls the printheads to eject ink drops from the nozzles.

In one embodiment, the module manager is implemented in an integrated circuit. In one embodiment, the integrated circuit is an application specific integrated circuit (ASIC).

In one embodiment, the module manager includes a clock generator which receives the input clock signal which has active edges at a defined frequency and provides the N output clock signals which each have active edges at a frequency N times slower than the defined frequency. In one embodiment, the module manager includes N registers which each receive the serial input data stream and each provide one of the N serial output data streams to a corresponding one of the N printheads. In one embodiment, where the N registers are correspondingly clocked by the N output clock signals, the module manager receives the data in the serial input data stream at N times the speed that each of the N serial output data streams is provided to the corresponding one of the N printheads.

In one embodiment, a plurality of inkjet printhead subassemblies or modules form one inkjet printhead assembly. The inkjet printhead modules each include a carrier which carries a plurality of printheads and a module manager.

One aspect of the present invention provides a wide-array inkjet printing system including a printer controller receiving and processing data related to the printer from a host system, and providing a first serial data stream and corresponding first clock signal. The wide-array inkjet printing system includes an inkjet printhead assembly having a carrier, N printheads disposed on the carrier, and a module manager disposed on the carrier. The module manager receives the first serial data stream and a first clock signal from the printer controller. The module manager demultiplexes the first serial data stream into N serial output data streams. The module manager provides the N serial output data streams and N corresponding output clock signals based on the first clock signal to the N printheads.

One aspect of the present invention provides a method of inkjet printing including receiving, at a module manager disposed on a carrier, a serial input data stream and a corresponding input clock signal from a printer controller located external from the carrier. The method also includes demultiplexing, at the module manager, the serial data stream into N serial output data streams. The method also includes providing, from the module manager, the N serial output data streams and N corresponding output clock signals based on the input clock signal to N printheads disposed on the carrier.

The present invention can provide an inkjet printhead assembly that can be incorporated into wide-array inkjet printing system where the number of conductive paths in the print data interconnect between the printer controller and inkjet printhead assembly is significantly reduced, because the module manager is capable of much faster data rates than data rates provided by current printheads. This reduction in the number of conductive paths in the print data interconnect significantly reduces costs and improves reliability of the printhead assembly and the wide-array inkjet printing system.

DESCRIPTION OF THE PREFERRED EMBODIMENTS

In the following detailed description of the preferred embodiments, reference is made to the accompanying drawings which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. The inkjet printhead assembly and related components of the present invention can be positioned in a number of different orientations. As such, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
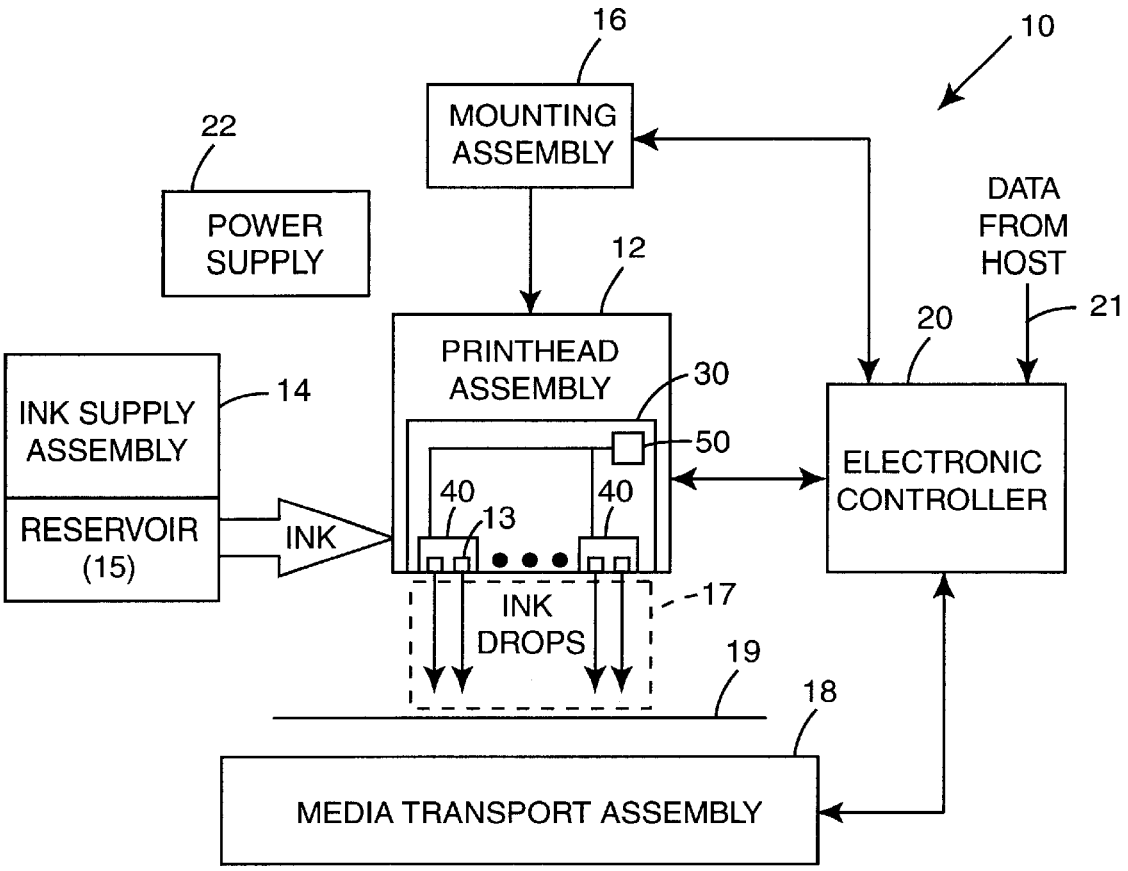
FIG. 1 is a block diagram illustrating one embodiment of an inkjet printing system according to the present invention.

FIG. 1 illustrates one embodiment of an inkjet printing system 10 according to the present invention. Inkjet printing system 10 includes an inkjet printhead assembly 12, an ink supply assembly 14, a mounting assembly 16, a media transport assembly 18, and an electronic controller 20. At least one power supply 22 provides power to the various electrical components of inkjet printing system 10. Inkjet printhead assembly 12 includes a plurality of printheads or printhead dies 40 which eject drops of ink through a plurality of orifices or nozzles 13 and toward a print medium 19 so as to print onto print medium 19. Print medium 19 is any type of suitable sheet material, such as paper, card stock, transparencies, Mylar, and the like. Typically, nozzles 13 are arranged in one or more columns or arrays such that properly sequenced ejection of ink from nozzles 13 causes characters, symbols, and/or other graphics or images to be printed upon print medium 19 as inkjet printhead assembly 12 and print medium 19 are moved relative to each other.

Ink supply assembly 14 supplies ink to printhead assembly 12 and includes a reservoir 15 for storing ink. As such, ink flows from reservoir 15 to inkjet printhead assembly 12. Ink supply assembly 14 and inkjet printhead assembly 12 can form either a one-way ink delivery system or a recirculating ink delivery system. In a one-way ink delivery system, substantially all of the ink supplied to inkjet printhead assembly 12 is consumed during printing. In a recirculating ink delivery system, however, only a portion of the ink supplied to printhead assembly 12 is consumed during printing. As such, ink not consumed during printing is returned to ink supply assembly 14.

In one embodiment, inkjet printhead assembly 12 and ink supply assembly 14 are housed together in an inkjet cartridge or pen. In another embodiment, ink supply assembly 14 is separate from inkjet printhead assembly 12 and supplies ink to inkjet printhead assembly 12 through an interface connection, such as a supply tube. In either embodiment, reservoir 15 of ink supply assembly 14 may be removed, replaced, and/or refilled. In one embodiment, where inkjet printhead assembly 12 and ink supply assembly 14 are housed together in an inkjet cartridge, reservoir 15 includes a local reservoir located within the cartridge as well as a larger reservoir located separately from the cartridge. As such, the separate, larger reservoir serves to refill the local reservoir. Accordingly, the separate, larger reservoir and/or the local reservoir may be removed, replaced, and/or refilled.

Mounting assembly 16 positions inkjet printhead assembly 12 relative to media transport assembly 18 and media transport assembly 18 positions print medium 19 relative to inkjet printhead assembly 12. Thus, a print zone 17 is defined adjacent to nozzles 13 in an area between inkjet printhead assembly 12 and print medium 19. In one embodiment, inkjet printhead assembly 12 is a scanning type printhead assembly. As such, mounting assembly 16 includes a carriage for moving inkjet printhead assembly 12 relative to media transport assembly 18 to scan print medium 19. In another embodiment, inkjet printhead assembly 12 is a non-scanning type printhead assembly. As such, mounting assembly 16 fixes inkjet printhead assembly 12 at a prescribed position relative to media transport assembly 18. Thus, media transport assembly 18 positions print medium 19 relative to inkjet printhead assembly 12.

Electronic controller or printer controller 20 typically includes a processor, firmware, and other printer electronics for communicating with and controlling inkjet printhead assembly 12, mounting assembly 16, and media transport assembly 18. Electronic controller 20 receives data 21 from a host system, such as a computer, and includes memory for temporarily storing data 21. Typically, data 21 is sent to inkjet printing system 10 along an electronic, infrared, optical, or other information transfer path. Data 21 represents, for example, a document and/or file to be printed. As such, data 21 forms a print job for inkjet printing system 10 and includes one or more print job commands and/or command parameters.

In one embodiment, logic and drive circuitry are incorporated in a module manager integrated circuit (IC) 50 according to the present invention located on inkjet printhead assembly 12. Electronic controller 20 and module manager IC 50 operate together to control inkjet printhead assembly 12 including timing control for ejection of ink drops from nozzles 13. As such, electronic controller 20 and module manager IC 50 define a pattern of ejected ink drops which form characters, symbols, and/or other graphics or images on print medium 19. Timing control and, therefore, the pattern of ejected ink drops, is determined by the print job commands and/or command parameters.

In one embodiment, inkjet printhead assembly 12 is a wide-array or multi-head printhead assembly. In one embodiment, inkjet printhead assembly 12 includes a carrier 30, which carries printhead dies 40 and module manager IC 50. In one embodiment carrier 30 provides electrical communication between printhead dies 40, module manager IC 50, and electronic controller 20, and fluidic communication between printhead dies 40 and ink supply assembly 14.

Figure 2:
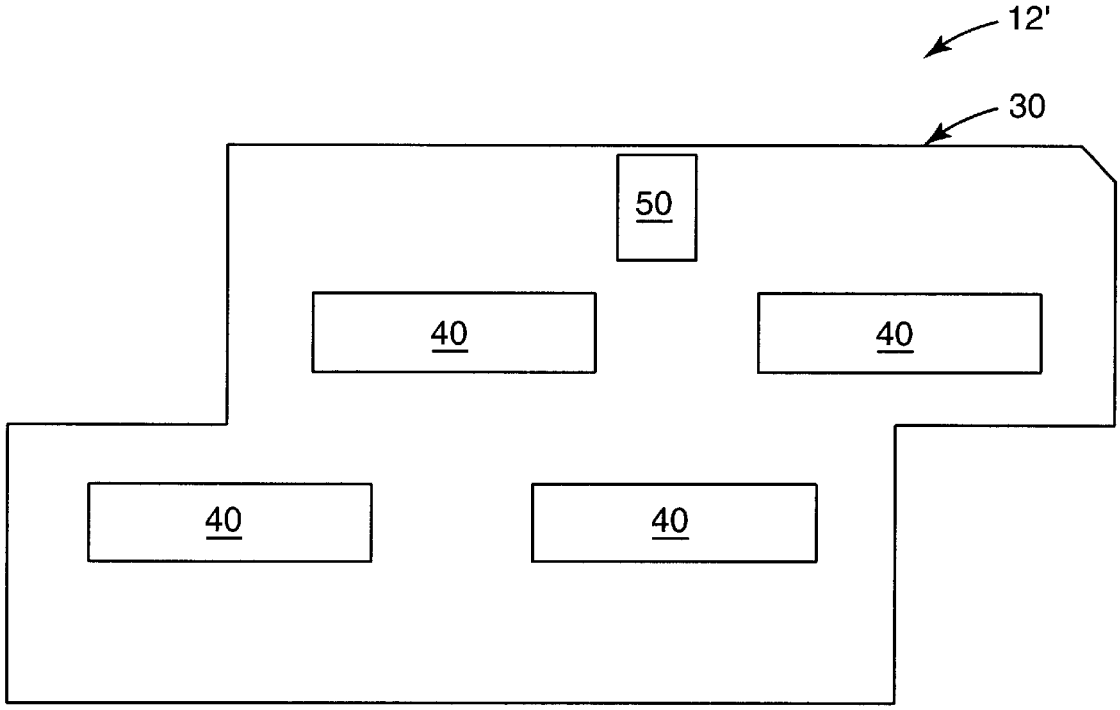
FIG. 2 is a diagram of one embodiment of an inkjet printhead subassembly or module according to the present invention.

In one embodiment, printhead dies 40 are spaced apart and staggered such that printhead dies 40 in one row overlap at least one printhead die 40 in another row. Thus, inkjet printhead assembly 12 may span a nominal page width or a width shorter or longer than nominal page width. In one embodiment, a plurality of inkjet printhead sub-assemblies or modules 12' (illustrated in FIG. 2) form one inkjet printhead assembly 12. The inkjet printhead modules 12' are substantially similar to the above described printhead assembly 12 and each have a carrier 30 which carries a plurality of printhead dies 40 and a module manager IC 50. In one embodiment, the printhead assembly 12 is formed of multiple inkjet printhead modules 12' which are mounted in an end-to-end manner and each carrier 30 has a staggered or stair-step profile. As a result, at least one printhead die 40 of one inkjet printhead module 12' overlaps at least one printhead die 40 of an adjacent inkjet printhead module 12'.

Figure 3:
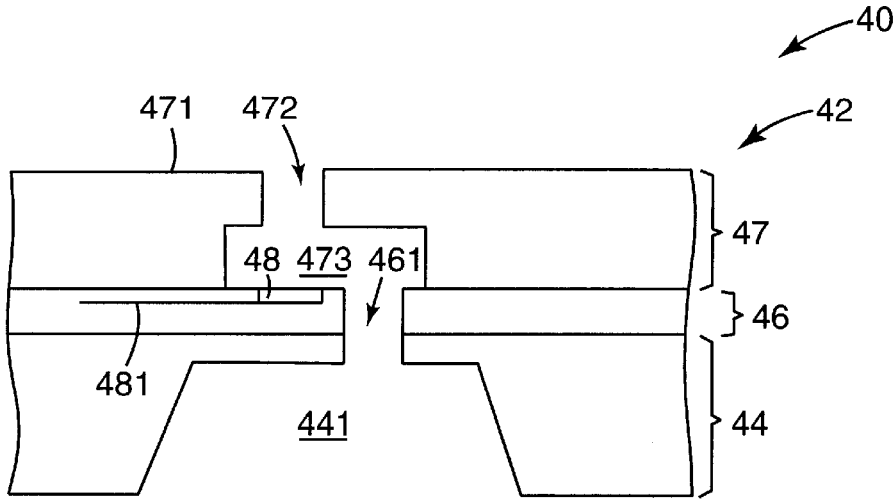
FIG. 3 is an enlarged schematic cross-sectional view illustrating portions of a one embodiment of a printhead die in the printing system of FIG. 1.

A portion of one embodiment of a printhead die 40 is illustrated schematically in FIG. 3. Printhead die 40 includes an array of printing or drop ejecting elements 42. Printing elements 42 are formed on a substrate 44 which has an ink feed slot 441 formed therein. As such, ink feed slot 441 provides a supply of liquid ink to printing elements 42. Each printing element 42 includes a thin-film structure 46, an orifice layer 47, and a firing resistor 48. Thin-film structure 46 has an ink feed channel 461 formed therein which communicates with ink feed slot 441 of substrate 44. Orifice layer 47 has a front face 471 and a nozzle opening 472 formed in front face 471. Orifice layer 47 also has a nozzle chamber 473 formed therein which communicates with nozzle opening 472 and ink feed channel 461 of thin-film structure 46. Firing resistor 48 is positioned within nozzle chamber 473 and includes leads 481 which electrically couple firing resistor 48 to a drive signal and ground.

During printing, ink flows from ink feed slot 441 to nozzle chamber 473 via ink feed channel 461. Nozzle opening 472 is operatively associated with firing resistor 48 such that droplets of ink within nozzle chamber 473 are ejected through nozzle opening 472 (e.g., normal to the plane of firing resistor 48) and toward a print medium upon energization of firing resistor 48.

Example embodiments of printhead dies 40 include a thermal printhead, a piezoelectric printhead, a flex-tensional printhead, or any other type of inkjet ejection device known in the art. In one embodiment, printhead dies 40 are fully integrated thermal inkjet printheads. As such, substrate 44 is formed, for example, of silicon, glass, or a stable polymer and thin-film structure 46 is formed by one or more passivation or insulation layers of silicon dioxide, silicon carbide, silicon nitride, tantalum, poly-silicon glass, or other suitable material. Thin-film structure 46 also includes a conductive layer which defines firing resistor 48 and leads 481. The conductive layer is formed, for example, by aluminum, gold, tantalum, tantalum-aluminum, or other metal or metal alloy.

Figure 4:
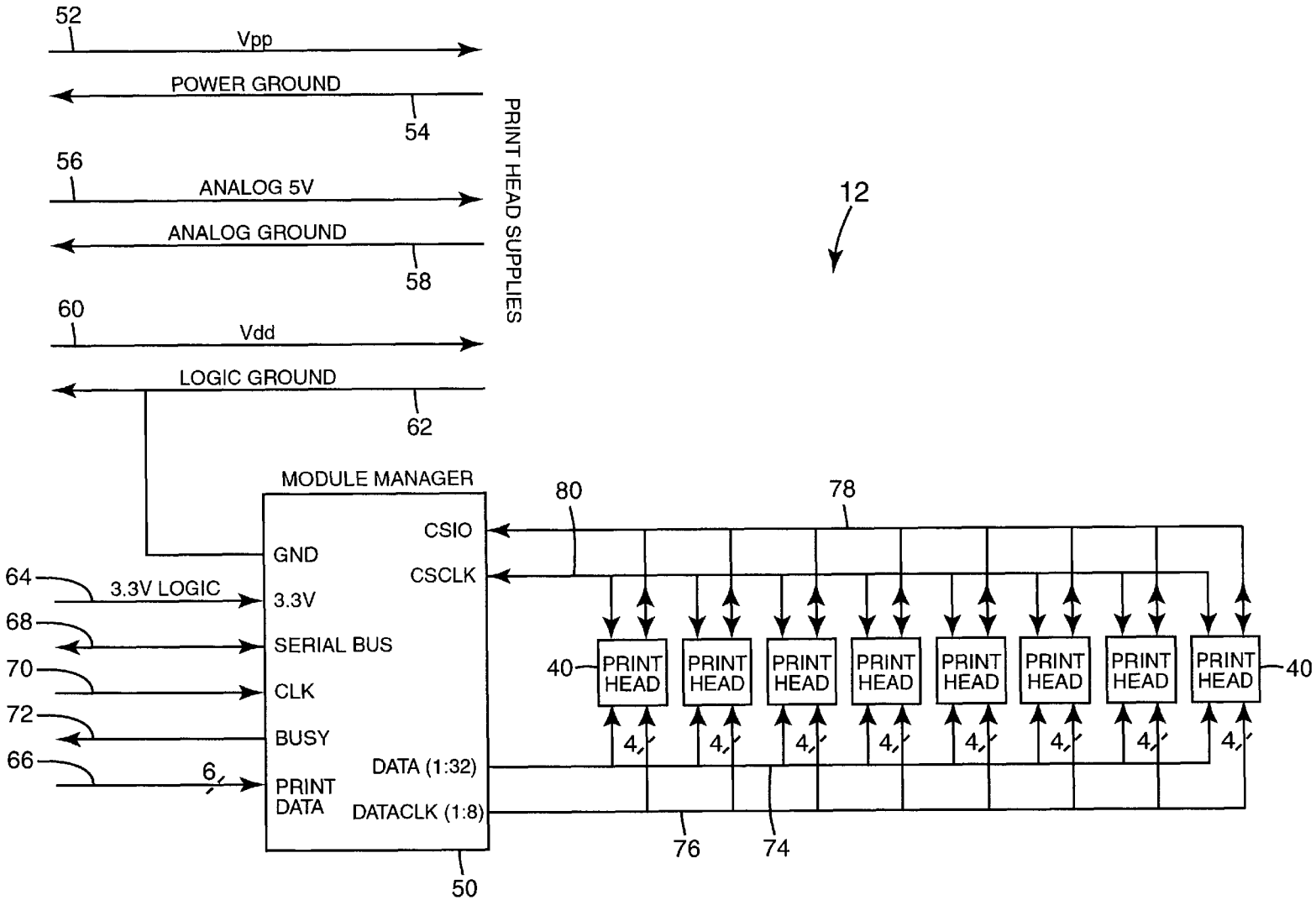
FIG. 4 is a block diagram illustrating a portion of an inkjet printhead assembly having a module manager integrated circuit (IC) according to the present invention.

A portion of inkjet printhead assembly 12 is illustrated generally in FIG. 4. Inkjet printhead assembly 12 includes complex analog and digital electronic components. Thus, inkjet printhead assembly 12 includes printhead power supplies for providing power to the electronic components within printhead assembly 12. For example, a Vpp power supply 52 and corresponding power ground 54 supply power to the firing resisters in printheads 40. An example 5-volt analog power supply 56 and corresponding analog ground 58 supply power to the analog electronic components in printhead assembly 12. An example 5-volt logic supply 60 and a corresponding logic ground 62 supply power to logic devices requiring a 5-volt logic power source. A 3.3-volt logic power supply 64 and the logic ground 62 supply power to logic components requiring a 3.3-volt logic power source, such as module manager 50. In one embodiment, module manager 50 is an application specific integrated circuit (ASIC) requiring a 3.3-volt logic power source.

In the example embodiment illustrated in FIG. 4, printhead assembly 12 includes eight printheads 40. Printhead assembly 12 can include any suitable number (N) of printheads. Before a print operation can be performed, data must be sent to printheads 40. Data includes, for example, print data and non-print data for printheads 40. Print data includes, for example, nozzle data containing pixel information, such as bitmap print data. Non-print data includes, for example, command/status (CS) data, clock data, and/or synchronization data. Status data of CS data includes, for example, printhead temperature or position, printhead resolution, and/or error notification.

Module manager IC 50 according to the present invention receives data from electronic controller 20 and provides both print data and non-print data to the printheads 40. For each printing operation, electronic controller sends nozzle data to module manager IC 50 on a print data line 66 in a serial format. The nozzle data provided on print data line 66 may be divided into two or more sections, such as even and odd nozzle data. In the example embodiment illustrated in FIG. 4, serial print data is received on print data line 66 which is 6 bits wide. The print data line 66 can be any suitable number of bits wide.

Independent of nozzle data, command data from electronic controller 20 may be provided to and status data read from printhead assembly 12 over a serial bi-directional non-print data serial bus 68.

A clock signal from electronic controller 20 is provided to module manager IC 50 on a clock line 70. A busy signal is provided from module manager IC 50 to electronic controller 20 on a line 72.

Module manager IC 50 receives the print data on line 66 and distributes the print data to the appropriate printhead 40 via data line 74. In the example embodiment illustrated in FIG. 4, data line 74 is 32 bits wide to provide four bits of serial data to each of the eight printheads 40. Data clock signals based on the input clock received on line 70 are provided on clock line 76 to clock the serial data from data line 74 into the printheads 40. In the example embodiment illustrated in FIG. 4, clock line 76 is eight bits wide to provide clock signals to each of the eight printheads 40.

Module manager IC 50 writes command data to and reads status data from printheads 40 over serial bi-directional CS data line 78. A CS clock is provided on CS clock line 80 to clock the CS data from CS data line 78 to printheads 40 and to module manager 50.

In the example embodiment of inkjet printhead assembly 12 illustrated in FIG. 4, the number of conductive paths in the print data interconnect between electronic controller 20 and inkjet printhead assembly 12 is significantly reduced, because an example module manager IC (e.g., ASIC) 50 is capable of much faster data rates than data rates provided by current printheads. For one example printhead design and example module manager ASIC 50 design, the print data interconnect is reduced from 32 pins to six lines to achieve the same printing speed, such as in the example embodiment of inkjet printhead assembly 12 illustrated in FIG. 4. This reduction in the number of conductive paths in the print data interconnect significantly reduces costs and improves reliability of the printhead assembly and the printing system.

In addition, module manager IC 50 can provide certain functions that can be shared across all the printheads 40. In this embodiment, the printhead 40 can be designed without certain functions, such as memory and/or processor intensive functions, which are instead performed in module manager IC 50. In addition, functions performed by module manager IC 50 are more easily updated during testing, prototyping, and later product revisions than functions performed in printheads 40.

Moreover, certain functions typically performed by electronic controller 20 can be incorporated into module manager IC 50. For example, one embodiment of module manager IC 50 monitors the relative status of the multiple printheads 40 disposed on carrier 30, and controls the printheads 40 relative to each other, which otherwise could only be monitored/controlled relative to each other off the carrier with the electronic controller 20.

In one embodiment, module manager IC 50 permits standalone printheads to operate in a multi-printhead printhead assembly 12 without modification. A standalone printhead is a printhead which is capable of being independently coupled directly to an electronic controller. One example embodiment of printhead assembly 12 includes standalone printheads 40 which are directly coupled to module manger IC 50.

Figure 5:
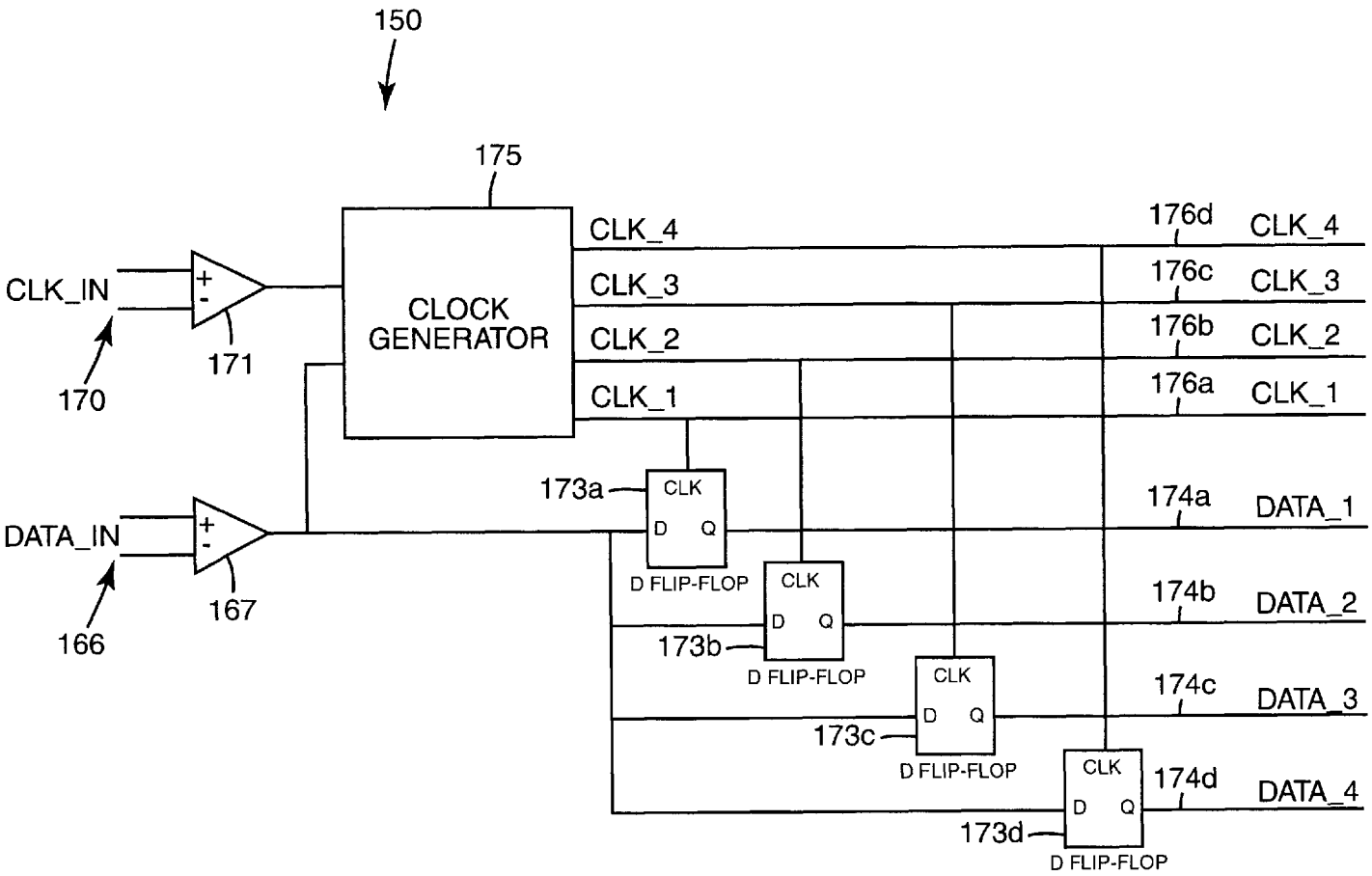
FIG. 5 is a block diagram of a portion of a module manager IC according to the present invention.

A block diagram of a portion of a module manager IC 150 according to the present invention is illustrated generally in FIG. 5. The portion of module manager IC 150 illustrated in FIG. 5 illustrates a serial-to-serial demultiplexing function of module manager IC 150. Nozzle print data from an electronic controller 20 is provided to module manager 150 on differential DATA_IN lines 166 in a serial format. A differential receiver 167 receives the nozzle print data on DATA_IN lines 166 and provides nozzle print data to a clock generator 175 and to D FLIP-FLOPS registers 173*a*–173*d*. A differential clock signal from electronic controller 20 is provided to module manager IC 150 on differential CLK_IN lines 170. A differential receiver 171 receives the differential clock signal on differential CLK_IN lines 170 and provides a clock signal to clock generator 175. Clock generator 175 accordingly provides a CLK_1 signal on a clock line 176*a*, a CLK_2 signal on a clock line 176*b*, a CLK_3 signal on a clock line 176*c*, and a CLK_4 signal on a clock line 176*d*. The clock signals CLK_1 through CLK_4 are respectively provided to the clock inputs of D FLIP-FLOPS 173*a*–173*d*.

D FLIP-FLOP 173*a* provides a DATA_1 signal on a line 174*a*. D FLIP-FLOP 173*b* provides a DATA_2 signal on a line 174*b*. D FLIP-FLOP 173*c* provides a DATA_3 signal on a line 174*c*. D FLIP-FLOP 173*d* provides a DATA_4 signal on a line 174*d*. Data signals DATA_1 through DATA_4 on lines 174*a*–174*d* and clock signals CLK_1 through CLK_4 on lines 176*a*–176*d* are provided to four corresponding printheads 40 controlled by module manager IC 150.

Figure 6:
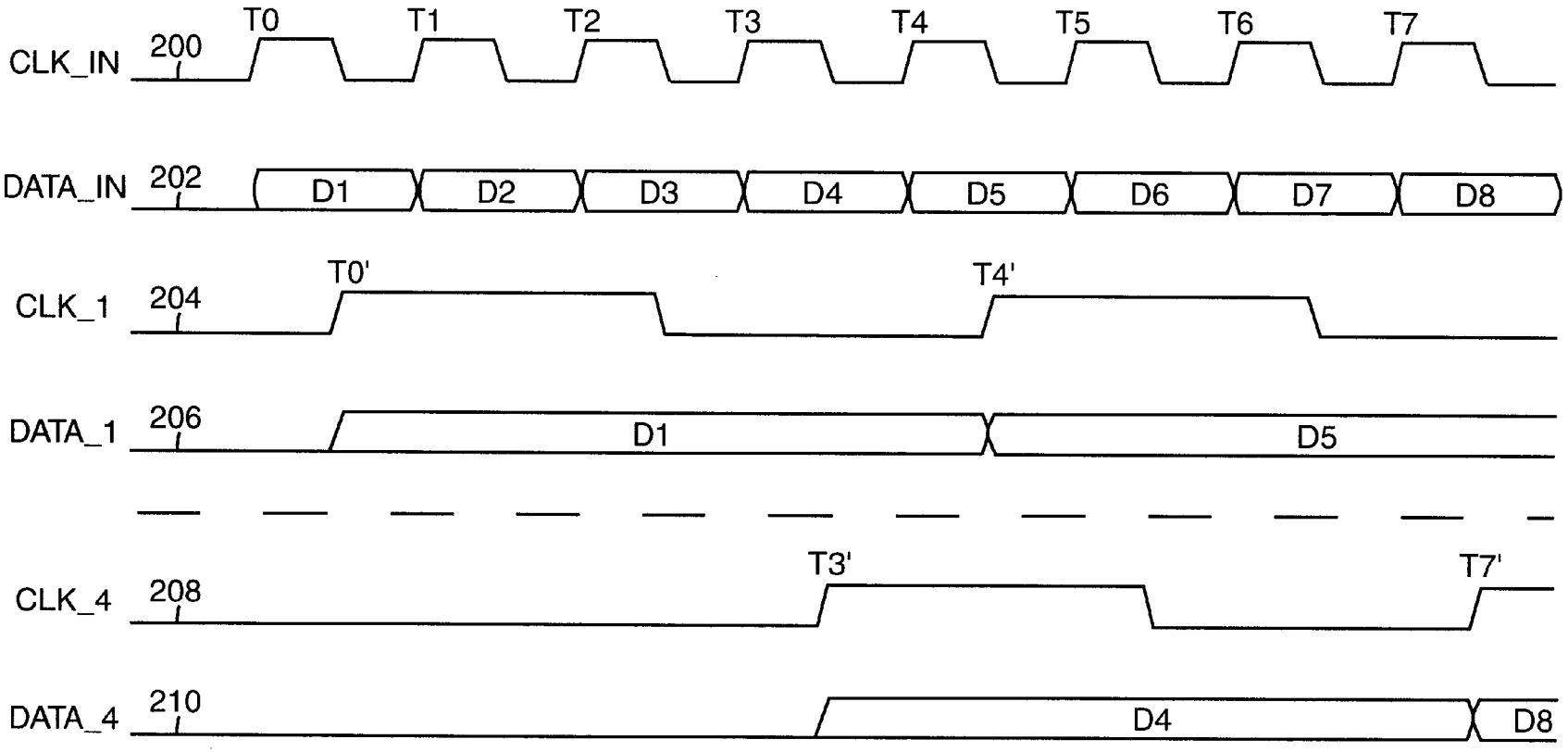
FIG. 6 is a timing diagram illustrating the operation of the portion of the module manager IC of FIG. 5.

The operation of the serial-to-serial demultiplexing function of module manager IC 150 is representatively illustrated in timing diagram form for the DATA_1 and DATA_4 output serial data streams to the printheads 40 in FIG. 6. In FIG. 6, the CLK_IN signal to clock generator 175 is indicated by trace 200. The DATA_IN serial data stream to clock generator 175 and the D FLIP-FLOPS 173*a*–173*d* is indicated by trace 202. The CLK_1 signal on line 176*a* is indicated by trace 204. The DATA_1 signal on line 174*a* is indicated by trace 206. The CLK_4 signal on line 176*d* is indicated by trace 208. The DATA_4 signal on line 174*d* is indicated by trace 210.

The rising edges of the CLK_IN signal in trace 200 are indicated at times T0, T1, T2, T3, T4, T5, T6, and T7. The serial data stream in the DATA_IN signal to D FLIP-FLOPS 173*a*–173*d* in trace 202 is indicated as D1, D2, D3, D4, D5, D6, D7, and D8.

As indicated by trace 204, the CLK_1 signal has a rising edge at time T0' and another rising edge at T4'. Accordingly, as indicated by trace 206, the DATA_1 signal on line 174*a* provides the input data D1 on line 174*a* from time T0' to time T4' and provides the input data D5 on line 174*a* beginning at time T4'.

As indicated by trace 208, the CLK_4 has rising edges at times T3' and T7'. Accordingly, as indicated by trace 210, input data D4 is provided as DATA_4 on line 174*d* between times T3' and T7' and input data D8 is provided as DATA_4 on line 174*d* beginning at time T7'.

For clarity, only the DATA_1 and DATA_4 serial data streams to the printheads 40 are illustrated in FIG. 6, but the clock and data timing for the serial data streams for the DATA_2 and DATA_3 signals fall at inform intervals between the edges for data signals DATA_1 and DATA_4. Thus, clock generator 175 receives the CLK_IN having active edges at a defined frequency and provides the CLK_1 through CLK_4 signals, which each have active edges at a frequency N times slower than the defined frequency. As a result, module manager IC 150 receives DATA_IN on differential input line 166 at four times the speed that the data is provided to each individual printhead 40 for the example embodiment of module manager IC 150 illustrated in FIGS. 5 and 6.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the chemical, mechanical, electromechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. An inkjet printhead assembly, comprising:

a carrier;

N printheads disposed on the carrier; and a module manager disposed on the carrier and adapted to receive a serial input data stream and corresponding input clock signal, which has active edges at a defined frequency, from a printer controller located external from the inkjet printhead assembly, the module manager including:

a clock generator adapted to receive the input clock signal and to provide N output clock signals, each having active edges at a frequency N times slower than the defined frequency and being provided to a corresponding one of the N printheads; and N registers each adapted to receive the serial input data stream and a corresponding one of the N output clock signals and to provide one of N serial output data streams to a corresponding one of the N printheads.

2. The inkjet printhead assembly of claim 1, wherein the input data stream comprises print data.

3. The inkjet printhead assembly of claim 2, wherein the print data comprises nozzle data, the N printheads each include a plurality of nozzles, and the nozzle data controls the printheads to eject ink drops from the nozzles.

4. The inkjet printhead assembly of claim 1, wherein the module manager is implemented in an integrated circuit.

5. The inkjet printhead assembly of claim 1, wherein the module manager is implemented in an application specific integrated circuit (ASIC).

6. The printhead assembly of claim 1, wherein the module manager receives the data in the serial input data stream at N times the speed that each of the N serial output data streams is provided to the corresponding one of the N printheads.

7. An inkjet printhead assembly, comprising:

multiple inkjet printhead modules, each inkjet printhead module including:

a carrier;

N printheads disposed on the carrier; and a module manager disposed on the carrier and adapted to receive a serial input data stream and corresponding input clock signal, which has active edges at a defined frequency, from a printer controller located external from the inkjet printhead assembly, the module manager including:

a clock generator adapted to receive the input clock signal and to provide N output clock signals, each having active edges at a frequency N times slower than the defined frequency and being provided to a corresponding one of the N printheads: and N registers each adapted to receive the serial input data stream and a corresponding one of the N output clock signals and to provide one of N serial output data streams to a corresponding one of the N printheads.

8. The inkjet printhead assembly of claim 7, wherein the first data stream comprises print data.

9. The inkjet printhead assembly of claim 8, wherein the print data comprises nozzle data, the N printheads each include a plurality of nozzles, and the nozzle data controls the printheads to eject ink drops from the nozzles.

10. The inkjet printhead assembly of claim 7, wherein the module manager is implemented in an integrated circuit.

11. The inkjet printhead assembly of claim 7, wherein the module manager receives the data in the first serial data stream at N times the speed that each the N serial output data streams is provided to the corresponding one of the N printheads.

12. A method of operating an inkjet printhead assembly comprising:

receiving, at a module manager disposed on a carrier, a serial input data stream and a corresponding input clock signal, which has active edges at a defined frequency, from a printer controller located external from the carrier;

providing, from the module manager, N output clock signals based on the input clock signal, wherein each output clock signal has active edges at a frequency N times slower than the defined frequency and is provided to a corresponding one of N printheads disposed on the carrier;

receiving at the module manager, the serial input data stream into N registers;

controlling each of the N registers with a corresponding one of the N output clock signals; and providing, from each of the N registers, one of the N serial output data streams to a corresponding one of the N printheads.

13. The method of claim 12, wherein the input data stream comprises print data.

14. The method of claim 13, wherein the print data comprises nozzle data, the N printheads each include a plurality of nozzles, and the method further comprises:

ejecting ink drops from the nozzles based on the nozzle data.

15. The method of claim 12, wherein the module manager is implemented in an integrated circuit.

16. The method of claim 12, wherein the data in the serial input data stream is received at the module manager at N times the speed that each of the N serial output data streams is provided to the corresponding one of the N printheads.

17. A printhead assembly, comprising:

a carrier;

N printheads disposed on the carrier; and a module manager disposed on the carrier and adapted to receive a serial input data stream and corresponding input clock signal, which has active edges at a defined frequency, from a printer controller located external from the printhead assembly, the module manager including:

a clock generator adapted to receive the input clock signal and to provide N output clock signals, each having active edges at a frequency N times slower than the defined frequency and being provided to a corresponding one of the N printheads; and N registers each adapted to receive the serial input data streams and a corresponding one of the N output clock signals and to provide one of N serial output data streams to a corresponding one of the N printheads.

18. A fluid ejection assembly, comprising:

a carrier;

N fluid ejection devices disposed on the carrier; and a module manager disposed on the carrier and adapted to receive a serial input data stream and corresponding input clock signal, which has active edges at a defined frequency, from a printer controller located external from the fluid ejection assembly, the module manager including:

a clock generator adapted to receive the input clock signal and to provide and to demultiplex the serial data stream into N serial output data streams and to provide the N serial output data streams and N corresponding output clock signals, each having active edges at a frequency N times slower than the defined frequency and being provided based on the input clock signal to a corresponding one of the N fluid ejection devices; and N registers each adapted to receive the serial input data stream and a corresponding one of the N output clock signals and to provide one of N serial output data streams to a corresponding one of the N fluid ejection devices.

19. The fluid ejection assembly of claim 18, wherein the input data stream comprises ejection data.

20. The fluid ejection assembly of claim 19, wherein the ejection data comprises nozzle data, the N fluid ejection devices each include a plurality of nozzles, and the nozzle data controls the fluid ejection devices to eject fluid drops from the nozzles.

21. The fluid ejection assembly of claim 18, wherein the module manager is implemented in an integrated circuit.

22. The fluid ejection assembly of claim 18, wherein the module manager is implemented in an application specific integrated circuit (ASIC).

23. The fluid ejection assembly of claim 18, wherein the module manager receives the data in the serial input data stream at N times the speed that each of the N serial output data streams is provided to the corresponding one of the N fluid ejection devices.

* * * * *

UNITED STATES PATENT AND TRADEMARK OFFICE

CERTIFICATE OF CORRECTION

PATENT NO. : 6,585,339 B2
DATED : July 1, 2003
INVENTOR(S) : Schloeman et al.

It is certified that error appears in the above-identified patent and that said Letters Patent is hereby corrected as shown below:

Title page,
Item [73], Assignee is missing. The Assignee name and residence is -- Hewlett-Packard Development Company, L.P., Houston, Texas 77070. --

Signed and Sealed this

Twenty-fourth Day of August, 2004

JON W. DUDAS
*Director of the United States Patent and Trademark Office*